United States Patent [19]

Mampaey et al.

[11] Patent Number: 4,610,939

[45] Date of Patent: Sep. 9, 1986

[54] METHOD AND APPARATUS FOR THE TRANSFER OF AN ELECTROSTATICALLY DEPOSITED TONER IMAGE

[75] Inventors: Jozef L. Mampaey; Herman J. Remmerie, both of Kontich, Belgium

[73] Assignee: AGFA-GEVAERT N.V., Mortsel, Belgium

[21] Appl. No.: 689,988

[22] Filed: Jan. 9, 1985

[30] Foreign Application Priority Data

Jan. 16, 1984 [EP] European Pat. Off. ..... 84200049.9

[51] Int. Cl.[4] ..... G03G 13/10

[52] U.S. Cl. ..... 430/33; 430/35; 430/126; 355/3 P; 118/647

[58] Field of Search ..... 430/126, 33, 35, 36, 430/32; 355/3 P, 3 TR

[56] References Cited

U.S. PATENT DOCUMENTS 4,063,808 12/1977 Simpson ..... 355/3 TR
4,073,649 2/1978 Scouten ..... 430/126 X
4,330,788 5/1982 Hinz et al. ..... 355/3 P
4,348,098 9/1982 Koizumi et al. ..... 355/3 TR

*Primary Examiner*—John D. Welsh
*Attorney, Agent, or Firm*—William J. Daniel

[57] ABSTRACT

Method and apparatus for transferring an electrostatically deposited electrophoretic toner image including the step of transferring image-wise deposited toner particles dispersed in a stratum of carrier liquid having a volume resistivity of at least $10^9$ ohm.cm and a dielectric constant less than 3 from an electrically insulating surface onto a receptor element by contacting said liquid stratum while carried on the insulating surface with a surface of the receptor element while applying an electric field such that the receptor element has a polarity opposite to the polarity of the toner particles to effect such transfer, characterized in that before the image-wise liquid stratum touches the receptor element the carrier liquid stratum is given a corona-charge treatment by a corona-charge unit whereby said liquid stratum is charged to a polarity opposite to the charge of the toner particles.

11 Claims, 4 Drawing Figures

METHOD AND APPARATUS FOR THE TRANSFER OF AN ELECTROSTATICALLY DEPOSITED TONER IMAGE

The present invention relates to a method and apparatus for transferring a toner image which has been formed by developing an electrostatic latent image by means of an electrophoretic developer liquid.

In "direct"electrostatography, toner is electrostatically image-wise deposited and fixed to the surface of a recording element carrying an electrostatic charge pattern, which surface is usually the surface of a photoconductive layer, e.g. a white photoconductive zinc oxide-insulating binder layer. The toner may be dry electrostatically attractable marking powder or the toner component of an electrophoretic developer liquid comprising a dispersed phase of toner particles in a continuous phase of an insulating carrier liquid having a volume resistivity of at least $10^9$ ohm.cm and a dielectric content less than 3.

In "indirect" electrostatography toner is image-wise deposited on the surface of a recording element, usually the surface of an image-wise charged photoconductive layer, e.g. a photoconductive selenium layer, and subsequently transferred to and fixed on a receptor element, e.g. in the form of a paper sheet.

A survey of different methods for the production of electrostatic charge patterns on photoconductive electrically insulating recording materials and non-photoconductive electrically insulating recording materials is given in U.S. Pat. No. 4,130,670.

In indirect electrostatography the image transfer between the elements is effected by means of an electric field which must be of sufficient strength to overcome the forces holding the toner on the recording element and to attract the toner onto a receptor element. The transfer field is generally provided by ion emission from a corona discharge means, e.g. as described in the U.S. Pat. No. 2,807,233 or by a direct-current (D.C.) biased transfer roller or belt running in contact with the rear side of the receptor element.

An example of a bias roller transfer system utilising a wet toner is described in the U.S. Pat. No. 3,328,193. In that system the recording and receptor elements are kept in light contact during the image transfer. Published European Patent Application No. 0052789 relates to a process wherein a wet toner image is transferred from a recording element to a receptor sheet across a small air gap, e.g. of 1 to 50 microns, defined by spacer means, e.g. a screen-printing web. In a toner-image transfer method described in the published German Patent Application (DE-OS) No. 3,221,650 spacer particles are used.

In the reproduction of halftone originals, e.g. linework, it is very desirable for the toner image, which may e.g. be compressed of graphic characters (e.g. letters or ciphers) or of dots forming a half-tone image of a continuous tone original, to be of uniform optical density. In practice, it has been found that the quality of the toner image is often marred by the presence of randomly distributed minute spots or patches within the area of the toner image and even in the image background areas, which should be clean. The spots or patches are formed by localised excessive or spurious deposits of toner. This defect is particularly undesirable when using a non-porous receptor element, e.g. an aluminum sheet, serving as printing form base.

In the course of research relating to the transfer of electrophoretically deposited toner across a gap between the recording and receptor elements, in which image defects of the kind above referred to were found to occur, it has been found that the quality of the transfer image can be improved by influencing the electrical potential of the carrier liquid component, i.e., the continuous phase, of the electrophoretic developer deposited on the recording element. By giving this liquid a charge of opposite polarity to the image-forming toner particles, i.e., the dispersed phase, the image transfer conditions are affected in some way which prevents or reduces the occurrence of the afore said defects. It is thought that the occurrence of those defects might be caused by jumping of some toner particles from the developer deposit on the recording element onto the receptor element before such particles reach the liquid meniscus within which the properly controlled toner transfer takes place, and that the charging of the carrier liquid may restrain this premature toner particle transfer. However there may be some other explanation, which is not known.

According to the present invention there is provided a method of progressively transferring a toner image, formed by developing an electrostatic latent image by means of an electrophoretic developer liquid, from the surface of a first element to the surface of a second element, wherein said surfaces are progressively moved in spaced relationship through an image transfer zone at which there is maintained an electric field which causes the transfer of toner particles to occur within a meniscus of their carrier liquid bridging the adjacent element surfaces, characterised in that before each incremental area of the image reaches said meniscus, the developer in that area is subjected to electrostatic charging conditions which confer on the carrier liquid in that area a charge of a polarity opposite to the charge of the toner particles.

The charging of the carrier liquid in accordance with the invention reduces or avoids the occurrence of transfer image defects in the form of local excess or spurious toner deposits.

The extent to which the carrier liquid is charged, positively or negatively depending on the polarity of the charge of the toner particles, is a factor which influences the degree of improvement in transfer image quality. An increase in the magnitude of the charge conferred on the liquid tends, within a certain range, to improve the desired effect but obviously the electrostatic charging of the liquid must not be of such extent that it adversely affects the required toner transfer within the meniscus at the image transfer zone. The electrical potential which should be conferred on the liquid in order to achieve the best effect depends on a number of parameters, including the strength of the electric field responsible for the toner transfer at the transfer zone and the charge level of the toner particles, but for any given process conditions, that optimum potential for the liquid can readily be determined by trials. In various trail processes, it was found that for achieving very good results the charging conditions to which the developer image was exposed had to be such as to cause the electrical potential of the carrier liquid to change by an amount of at least 20 volts.

For conferring the required electrical potential on the continuous phase liquid component of the electrophoretic developer use is preferably made of one or more corona wires. Preferably each such corona wire is located so as to extend transversely of the path of the first element at a position in the immediate vicinity of the meniscus. Preferably the difference between the voltage of the corona wire and each surface bearing the toner image to be transferred is in the range 4.5 to 15 V. As an alternative to the use of a corona, use can be made of a radioactive rod or other element emitting electrically charged particles. When using an electrophoretic developer for developing a negatively charged electrostatic latent image, a radioactive source emitting beta particles may be used.

The invention is applicable both when using an electrophoretic developer liquid incorporating positively charged toner particles and when using such a developer incorporating negatively charged toner particles.

The invention is of particular importance in methods performed for producing toner transfer images of halftone originals, e.g. linework, or halftone toner images of screened continuous tone originals.

A particularly important use for a method according to the invention is in the production of a toner transfer image on a receptor sheet forming a printing form base as a step in the production of an offset printing plate. It is very suitable for that purpose to use a receptor sheet composed of anodised aluminium.

The invention includes apparatus for use in indirect electrostatography, comprising means for forming on a first element an electrostatic latent image, means for applying to the first element an electrophoretic developer liquid, comprising toner particles dispersed in an insulating liquid, for forming a developer image corresponding to such latent image, means for conducting such first element and a second element in spaced relationship along predetermined paths through an image transfer zone with the developer image sandwiched between the elements, and means for generating an electric field at that zone for causing progressive transfer of the toner image from said first to said second element, characterised in that the apparatus includes means for emitting electric charges of a polarity opposite to the charge of the toner particles in the imagewise deposited developer liquid, at a region adjacent the path of the first element and upstream of such transfer zone for conferring a charge of such opposite polarity on the carrier liquid in each incremental area of the developed image before that area reaches the image transfer zone.

An embodiment of the invention, incorporating various preferred features, will now be described with reference to the accompanying diagrammatic drawings. In these drawings certain dimensions have been exaggerated for clarification.

Figure 3:
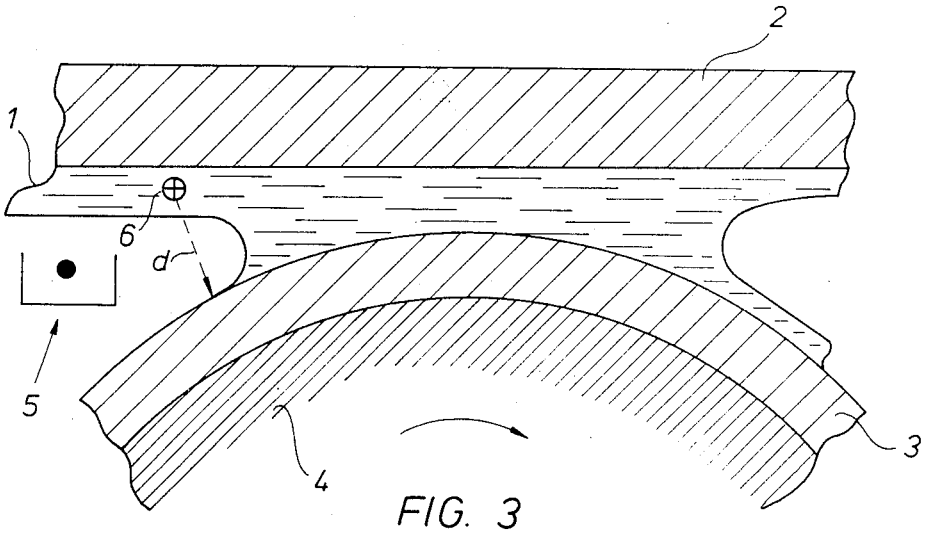
FIG. 3 represents a cross-sectional view of part of an image transfer station in which a toner image is transferred from a recording material to an aluminium receptor sheet.

FIG. 3 is an enlarged sectional view which shows the meniscus formed at the transfer station between the toner-containing liquid stratum 1 carried by the photoconductive recording layer 2 and the aluminium receptor sheet 3 which is temporarily attached to a supporting drum 4. The transfer of toner to the aluminium sheet occurs by electrophoresis as a function of the electrical field which is maintained at the transfer zone as known per se, e.g. by a source of electromotive force connected to an electrically conductive backing of the recording material 2 and the drum 4. The thinner the insulating liquid stratum the higher is the field strength effective in the transfer gap for causing the toner particle transfer.

Figure 1:
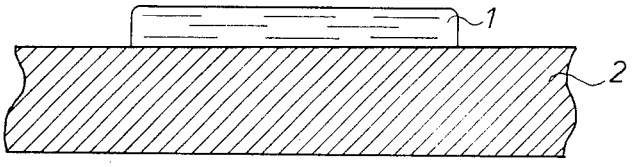
FIG. 1 represents a cross-sectional view of a part of a recording material 2 carrying in an electrostatically charged area a stratum of developer liquid 1 wherein toner particles are attracted by the charge pattern.
Figure 2:
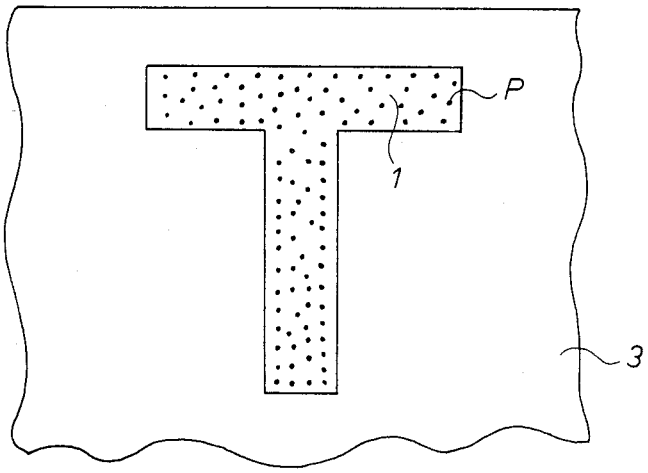
FIG. 2 represents a plan view of a transfer image 1 in the form of a letter "T" formed on a receptor sheet 3. The image is marred by randomly distributed minute spots P formed by locally heavier deposits of toner particles.

A corona-discharge unit 5 is located immediately preceding the transfer zone. This unit operates to charge the liquid on the recording material with a polarity opposite that of the toner particles. This charging of the liquid avoids or reduces the occurrence of the spots P in the transfer image, shown in FIG. 2. It is considered probable that those spots are caused by jump-over of toner particles from the developer image on the recording material before such particles reach the meniscus. In FIG. 3 the dotted line "d" represents the possible jump-over path of a toner particle 6. Whatever be the true explanation of the spots, their occurrence is reduced if not eliminated by the exposure of the electrophoretic developer image on the recording material to the charging conditions of the unit 5 so that the liquid in each increment of the image is given a charge of opposite polarity to the toner particles before that increment reaches the meniscus.

The electrophoretic developer layer on the recording material 2 preferably has a thickness in the range 1 to 20 microns. A layer of greater thickness may be squeezed too strongly between the recording and receptor elements, resulting in a pumping effect and spreading out of the image.

Figure 4:
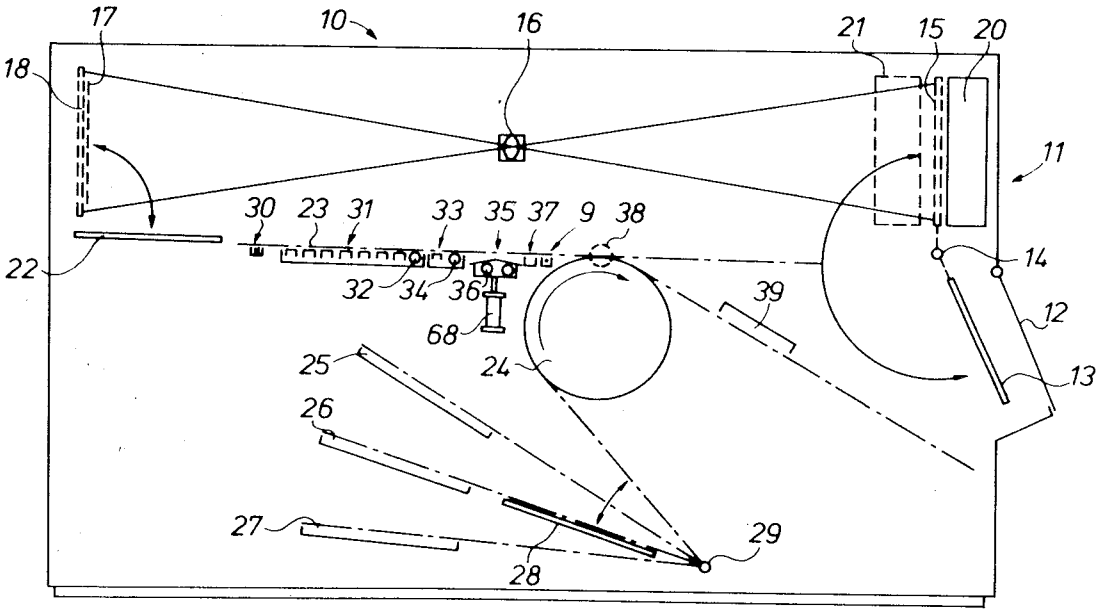
FIG. 4 represents a diagrammatic longitudinal sectional view of an electrophotographic apparatus incorporating the present invention.

FIG. 4 is a diagrammatic illustration of an electrophotographic apparatus serving as a lithographic platemaker for making lithographic printing plates from a paste-up. For use according to the present invention the apparatus includes the corona charging unit 9 mounted within an elongated light-tight housing 10 that is provided at its frontside 11 with a rectangular, light-tightly closable panel 12 that permits an operator to fit a paste-up to be reproduced onto a pivotable transparent holder 13. The holder 13 is preferably fitted with an underpressure system, so that by atmospheric pressure the paste-up may be urged into intimate contact with the flat supporting board of the holder. The holder may be swung about a horizontal pivot axis 14 into a vertical position 15 illustrated in broken lines. In that position the location of the paste-up is what in the drawing is at the left-hand side of the holder. The image of the paste-up is projected by a lens 16 onto a reusable photoconductor sheet 17 that is fitted to a sheet holder 18. The sheet 17 and the holder 18 have been illustrated in broken lines in a vertical position. They are pivotable from that position into an almost horizontal position to fit into a carriage 22 wherein the processing and the transfer of the toner image occur.

The lighting of a paste-up may occur by means of lamp boxes such as 20 and 21. The lamp box 21 is pivotable out of the path of holder 13, in order to permit the movements of the holder between its upper and lower position.

After exposure of the photoconductor holder 18 it is swung onto the chassis of the carriage 22 which is then moved along the substantially horizontal path indicated by the dash and dot line 23 that runs tangentially to a cylindrically curved sheet supporting member 24 also called transfer drum onto which a receptor sheet in the form of an uncoated anodized aluminium plate is fitted.

A suitable manner of mounting the photoconductor sheet to the photoconductor holder is disclosed in the published European Patent Application No. 0095220.

Aluminium plates of different formats are stored in bins 25, 26 and 27, and a plate transfer mechanism 28 that is pivotable at 29, is arranged to transfer a selected plate to the transfer drum 24. In case of smaller plate formats, the plates may be loaded in a bin in pairs for feeding to the drum in side by side relationship. A suitable device for gripping and lifting the plates in the mechanism 28 is disclosed in the published European Patent Application No. 0095218.

The transfer drum 24, is provided with means for receiving a plate or plates and for clamping it or them in a predetermined position on the periphery of the drum. A suitable construction for the drum that is capable of receiving different sheet formats and for tightly tensioning them on the drum, is disclosed in the published European Application No. 0089080.

The following processing stations are provided for the photoconductor sheet 17.

A corona charging station 30, e.g. as described in the published European Application No. 0095217, for the uniform charging of the photoconductor layer prior to the image-wise exposure.

A liquid toner developing station 31 wherein the electrostatic charge pattern that remains after the image-wise exposure, is developed, and wherein a reversely rotating roller 32 controls the thickness of the layer of remaining developing liquid. A suitable developing device is disclosed in the published European Application No. 0084907.

A rinsing station 33 wherein the photoconductor surface is rinsed with a toner-free liquid, such as isododecane, thereby to clear the background of the image, and wherein a reversely rotating roller 34 controls the thickness of the remaining rinsing liquid layer.

A toner transfer station, indicated by a circle 38 in broken line, wherein by the application of a suitable potential difference between a conductive backing of the photoconductive recording element and the aluminium receptor plate on the drum 24, the developer toner pattern is progressively transferred onto the aluminium receptor plate during the movement of the recording and receptor elements through such station.

A cleaning station 35 with rotatable resilient cleaning rollers 36 and scraper blades for cleaning the photoconductor during the return movement of the carriage along path 23. The cleaning means at station 35 can be vertically raised over some centimeters, by means of a mechanism represented diagrammatically by the cylinder 68, thereby to be operative only during such return movement of the carriage.

A reconditioning station 37 being an incandescent lamp emitting white light which prepares the photoconductor during its return movement for the next imaging cycle.

A drying station and fixing station 39 for treating the aluminium plate after it has been removed from the drum 24, and transferred to the outlet of the apparatus.

It will be understood that the apparatus comprises a plurality of other facilities such as electrical and electronic control means, liquid supply means, filters, safety dispositions, etc. All these facilities belong to the state of the art and they require no further description hereinafter.

An electrophoretic developer particularly suitable for use in the method of the present invention is described e.g. in GB-P No. 1 576 719.

The following data relate to the toner transfer in an apparatus as described in FIG. 3:

voltage difference between the corona wire(s) of the unit 5 and the photoconductive layer backing (dependent on the geometry of the corona): 4.5–15 kV,
voltage of housing of said corona wire(s): zero (grounded),
speed of photoconductor during transfer: 10 cm.sec$^{-1}$,
charge sign of the toner particles: positive,
charge sign of the electrostatic image: negative,
initial voltage height of said image: 350 V.

The diameter of the drum carrying the photoconductive layer was 56 cm.

The present invention can be applied in any apparatus for indirect electrostatography, whether the developed electrostatic latent image be formed electrophotographically or otherwise.

We claim:

1. A method of progressively transferring a liquid toner image, formed by developing an electrostatic latent image by means of an electrophoretic developer liquid, from the surface of a first element to the surface of a second element, wherein said surfaces are progressively moved in spaced relationship through an image transfer zone with the liquid toner image sandwiched therebetween and across which there is maintained an electric field which causes the transfer of toner particles to occur within a meniscus of their carrier liquid between the elements, characterized in that before each incremental area of the lump reaches said meniscus, the developer liquid in that area is subjected to electrostatic charging conditions which confer on the carrier liquid thereof in that area a charge of a polarity opposite to the charge of the toner particles.

2. A method according to claim 1, wherein the said charging of the carrier liquid is effected by corona discharge.

3. A method according to claim 1, wherein said electrostatic charging conditions are sufficient to change the electrical potential of the carrier liquid to change by an amount of at least 20 volts.

4. A method accordng to claim 1, wherein the corona discharge is generated by means of one or more corona wires extending transversely of the path of said first element at a position in the immediate vicinity of the meniscus.

5. A method according to claim 3, wherein the difference between the voltage of each such corona wire and the surface bearing the toner image to be transferred is in the range 4.5 to 15 V.

6. A method according to claim 1, wherein the thickness of the image to be transferred is in the range 1 to 20 microns.

7. A method according to claim 1, wherein the surface carrying the image to be transferred is the surface of a photoconductive layer.

8. A method according to claim 1, wherein the said second element is an aluminium sheet.

9. A method according to claim 1, wherein te said toner image is a screen dot image.

10. Apparatus for use in indirect electrostratography, comprising means for forming on a first element an electrostatic latent image, means for applying an electrophoretic developer liquid, comprising toner particles dispersed in an insulating carrier liquid, to form a liquid tomer image corresponding to such latent image, means for conducting such first element and a second element in spaced relationship along predetermined paths through an image transfer zone with the liquid toner image sandwiched therebetween, and means for generating an electric field across that zone for causing progressive transfer of the toner image from said first to said second element, characterised in that the apparatus includes means for emitting electric charges of a polarity opposite to the charge of the toner particles in the image-wise deposited developer, at a region adjacent the path of said first element and upstream of said transfer zone for conferring a charge of such opposite polarity on the carrier liquid in each incremental area of the liquid toner image before that area reaches said image transfer zone.

11. Apparatus according to claim 10, wherein said means for emitting electric charge of a polarity opposite to the charge of the toner particles comprises at least one corona wire.

* * * * *

UNITED STATES PATENT AND TRADEMARK OFFICE

CERTIFICATE OF CORRECTION

PATENT NO. : 4,610,939

DATED : September 9, 1986

INVENTOR(S) : Jozef L. Mampaey et al

It is certified that error appears in the above-identified patent and that said Letters Patent is hereby corrected as shown below:

In the Claims:

Column 6, line 62 (claim 6, line 2), -- liquid toner -- should be inserted after "the" and before "image".

Signed and Sealed this

Fourth Day of November, 1986

[SEAL]

*Attest:*

DONALD J. QUIGG

*Attesting Officer*

*Commissioner of Patents and Trademarks*